US010461431B2

(12) United States Patent
Lahti

(10) Patent No.: US 10,461,431 B2
(45) Date of Patent: Oct. 29, 2019

(54) ELECTRICALLY TUNABLE MINIATURE ANTENNA

(71) Applicant: Intel Corporation, Santa Clara, CA (US)

(72) Inventor: Saku Lahti, Tampere (FI)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/368,032

(22) Filed: Dec. 2, 2016

(65) Prior Publication Data

US 2017/0271773 A1 Sep. 21, 2017

Related U.S. Application Data

(63) Continuation of application No. 14/138,187, filed on Dec. 23, 2013, now Pat. No. 9,531,076.

(51) Int. Cl.

| | |
|---|---|
| ***H01Q 9/06*** | (2006.01) |
| ***H01Q 5/335*** | (2015.01) |
| ***H01Q 9/28*** | (2006.01) |
| ***H01Q 1/24*** | (2006.01) |

(52) U.S. Cl.
CPC ..... *H01Q 9/065* (2013.01); *H01Q 1/243* (2013.01); *H01Q 5/335* (2015.01); *H01Q 9/285* (2013.01)

(58) Field of Classification Search
CPC ..... H01Q 9/065; H01Q 9/285; H01Q 5/335; H01Q 1/243
See application file for complete search history.

(56) References Cited

U.S. PATENT DOCUMENTS

| | | | | |
|---|---|---|---|---|
| 9,531,076 | B2 | 12/2016 | Lahti | |
| 2004/0113851 | A1 | 6/2004 | Gothard et al. | |
| 2007/0216590 | A1* | 9/2007 | Montgomery | H01Q 9/285 343/745 |
| 2010/0302106 | A1* | 12/2010 | Knudsen | H01Q 1/241 343/702 |
| 2011/0095948 | A1* | 4/2011 | Alexopoulos | H01Q 9/285 343/700 MS |
| 2014/0062815 | A1* | 3/2014 | Tsai | H01Q 5/335 343/745 |

* cited by examiner

*Primary Examiner* — Hai V Tran
*Assistant Examiner* — Michael M Bouizza
(74) *Attorney, Agent, or Firm* — Schiff Hardin LLP

(57) ABSTRACT

Described herein are architectures, platforms and methods for electrically tuning radiators in a portable device.

20 Claims, 3 Drawing Sheets

ELECTRICALLY TUNABLE MINIATURE ANTENNA

BACKGROUND

An increasing number of wireless communication standards as applied to a portable device and a trend towards ever smaller, slimmer and lighter portable devices may cause major design challenges for antennas or radiators (hereinafter referred to as radiator in this document). Radiators represent a category of components that may fundamentally differ from other components in the portable device. For example, the radiator may be configured to efficiently radiate in free space, whereas the other components are more or less isolated from their surroundings.

Electrically small radiators are typically of resonant type. In other words, a length of a metallic radiator element is bound to a fraction of a wavelength at an operating frequency. In terms of impedance bandwidth (BW) and radiation efficiency, radiator miniaturization is a size versus performance trade-off.

A challenge of covering a single wide frequency band or multiple frequency bands may be solved with use of multiple radiators. Such a solution may not practical, because more radiator space and interconnections are needed in the portable device. Furthermore, mutual coupling between individual radiators may cause severe operating problems.

Many current portable device radiators are of wide-band or of multiple band type. In many of these radiators, the multiple band operation is achieved at the expense of a larger radiator size, and thereby necessitating performance compromises between the individual bands.

BRIEF DESCRIPTION OF THE DRAWINGS

The detailed description is described with reference to accompanying figures. In the figures, the left-most digit(s) of a reference number identifies the figure in which the reference number first appears. The same numbers are used throughout the drawings to reference like features and components.

DETAILED DESCRIPTION

Figure 1:
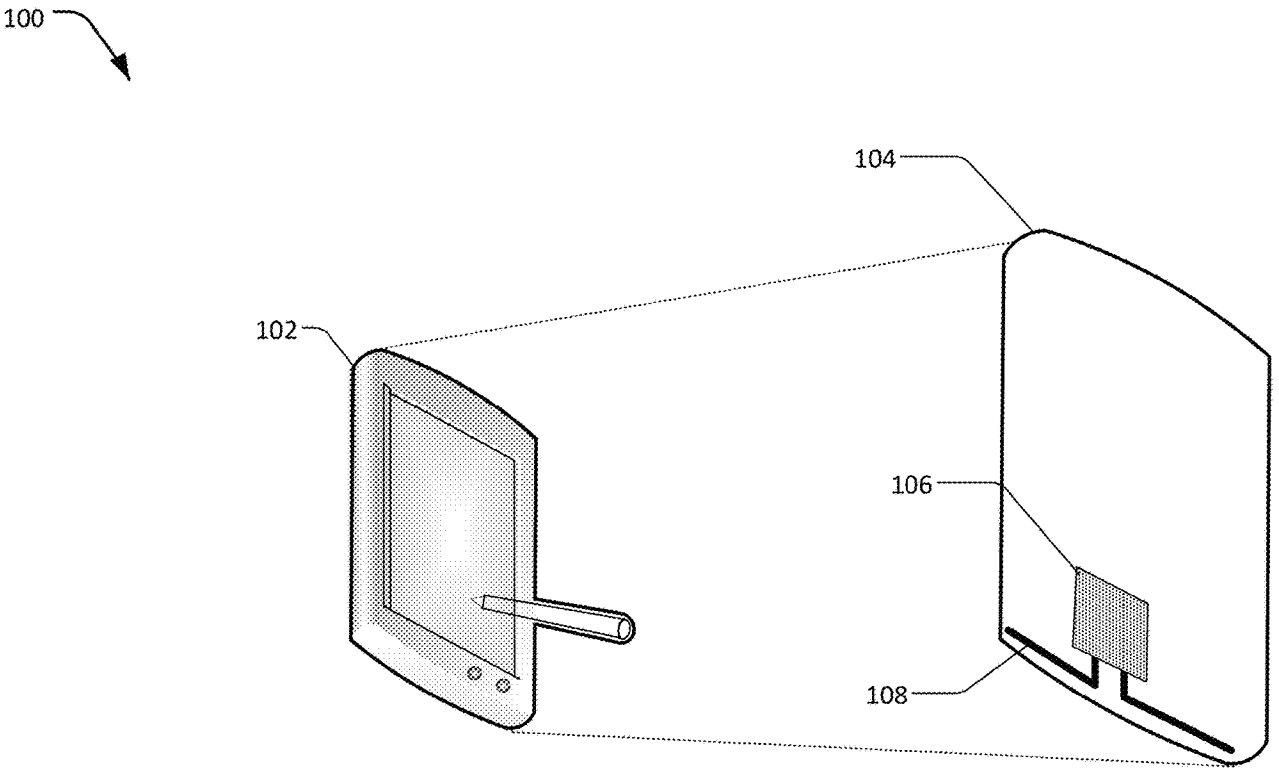
FIG. 1 is an example overview of components in a portable device as described in present implementations herein.

Described herein are architectures, platforms and methods for implementing electrically tunable miniaturized radiators (i.e., antennas) in a portable device. For example, an active impedance tuning facilitates the electrical tuning of the miniaturized radiators. In this example, the active impedance tuning includes a combiner and pre-matching circuit, a first reactive component, a tuning adjuster circuit that has a plurality of reactive components, and a post-matching circuit. The pre-matching and post match-circuits form an impedance matching for the above electrical tuning of radiators.

In an implementation, a mechanical integration of radiators (e.g., combined monopole radiators) into the portable device may be based upon space available within the portable device. For example, a radiator's physical length is designed to fit into the available space during mechanical integration. The physical length may not necessarily be resonant at a particular frequency. In this example, the active impedance tuning facilitates resonance at the particular frequency after the mechanical integration of the radiators into the portable device. The resonance at the particular frequency may be implemented by adjusting electrical length of the radiators.

As an example of present implementations herein, the electrical tuning involves combining of at least two monopole radiators and performing a pre-matching of impedance at a feed-point or a centerline of the combined monopole radiators. The feed-point is disposed along the centerline of the combined monopole radiators. On the other hand, the pre-matching together with the post-matching circuit form the impedance matching in the miniaturized radiators. The impedance matching takes into consideration circuit components in between a transceiver (i.e., transmitter and/or receiver) and the radiators. For example, the first reactive component and the tuning adjuster circuit are circuit components that are disposed in between the transceiver and the radiators.

After the pre-matching and combination, the first reactive component facilitates resonance at a first frequency range. For example, the first reactive component is an inductor whose inductance facilitates the resonance at the first frequency range. The first frequency range, for example, may be of a middle frequency range. From the middle frequency range, the plurality of reactive components of the tuning adjuster circuit may further facilitate resonance at other frequencies. For example, shunting the first reactive component with another reactive component will change the amount of the inductance. This change may generate another resonant frequency other than the first frequency range.

As an example of present implementations herein, a single-pole multiple-throw (SPMT) radio frequency (RF) switch may facilitate connection of the radiator to the tuning adjuster circuit. The switching, for example, shunts a particular reactive component to the first reactive component. In the case of the first frequency range, the RF switch is left open, is or not connected at all, to the plurality of reactive components.

FIG. 1 is an example system 100 showing components in a portable device 102 as described in present implementations herein. The system 100 illustrates a portable device 102, which comprises a chassis 104, a tuning and/or matching circuitry 106, and a radiator 108.

The portable device 102 may include, but is not limited to, a tablet computer, a netbook, a notebook computer, a laptop computer, mobile phone, a cellular phone, a smartphone, a personal digital assistant, a multimedia playback device, a digital music player, a digital video player, a navigational device, a digital camera, and the like. The portable device 102, for example, may communicate with another portable device (not shown) in a network environment. The network environment, for example, includes a cellular network configured to facilitate communications between the portable device 102 and the other portable device.

As an example of present implementation herein, the portable device 102 utilizes the radiator 108 in communicating with another portable device. The radiator 108 may include monopole radiators of different shapes and/or configurations. For example, the radiator 108 may include two monopole radiators that are symmetric or non-symmetric with one another. In another example, the radiator 108 may include a square shape, a circular shape, etc. and the radiator 108 is of different sizes when fitted into the available space in the portable device 102. In this example, the available space in the portable device 102 may dictate the shape and size of the radiator metallic or conductive 108.

With continuing reference to FIG. 1, the chassis 104 may act as a ground plane for the radiator 108. Particularly, the chassis 104 may form part of the radiator 108 by facilitating efficient radiation during transmission and by facilitating efficient reception during receiving of signals. For example, during transmission, the chassis 104 is disposed in a manner that it generates in-phase radiated signals. In this example, field strength due to radiation by the radiator 108 is further strengthened by the radiation from the chassis 104. Chassis 104 may act as a "counterweight" to the radiator 108, where chassis 104 acts as a one arm of a dipole antenna, where the other arm is constructed by two monopoles. The chassis may be metallic or any conductive type of material.

In an implementation, the tuning and/or matching circuitry 106 may include active circuit components (not shown) to facilitate impedance matching of the radiator 108. For example, the active circuit components include different amount of reactance to generate resonance at different frequency ranges. In this example, the active circuit components (not shown) match the impedance of the radiator 108 at different frequency bands.

Although the overview 100 illustrates in a limited manner basic components of a transceiver circuitry in the portable device 102, other components such as battery, one or more processors, SIM card, etc. were not described in order to simplify the embodiments described herein.

Figure 2:
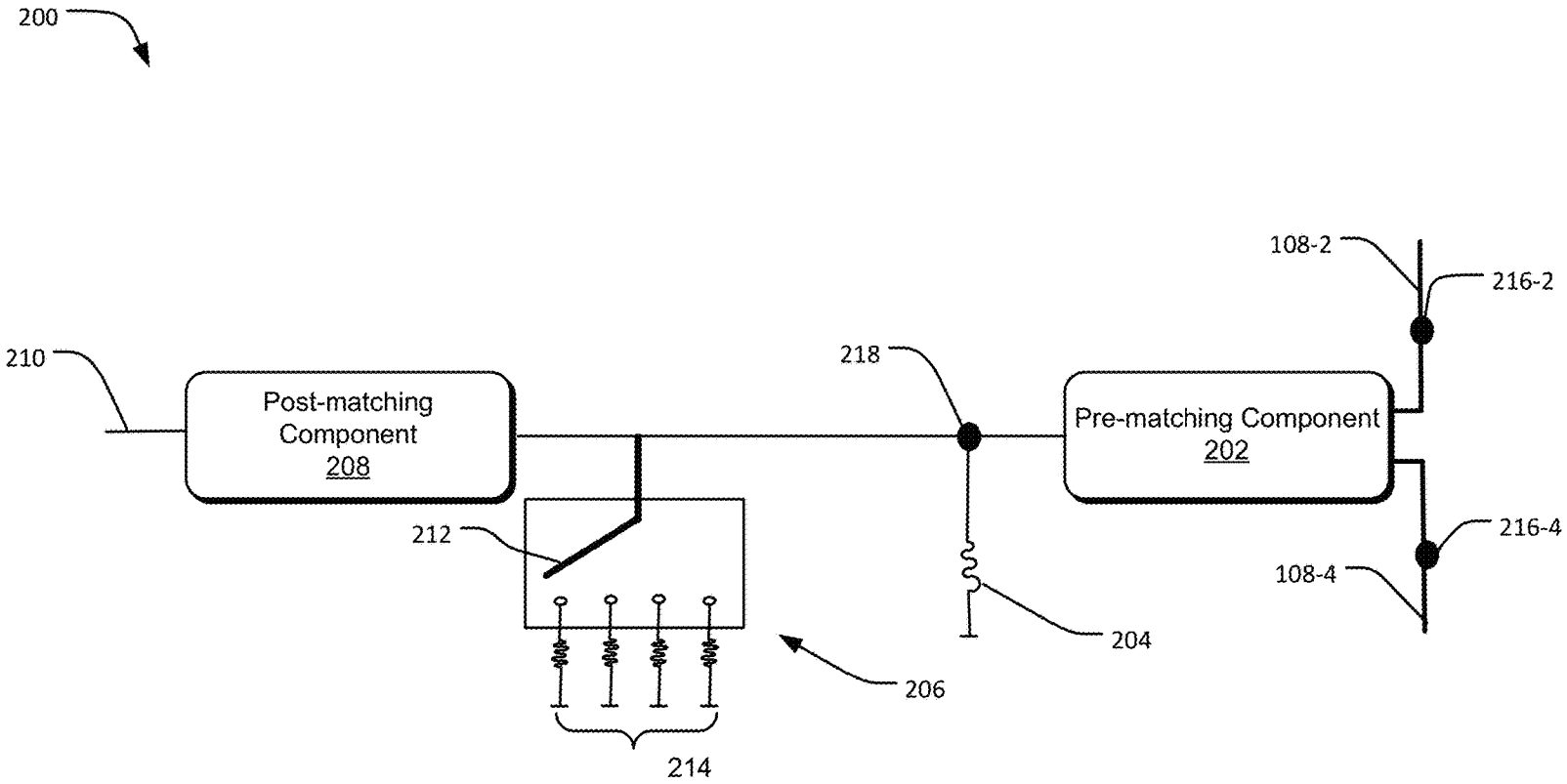
FIG. 2 is an example apparatus that is configured to implement electrical tuning of a miniaturized radiator as described in present implementations herein.

FIG. 2 illustrates an example apparatus 200 that is configured to implement electrical tuning of the miniaturized radiator in the portable device 102. As shown, the apparatus 200 shows the radiator 108, a pre-matching component (circuit) 202, a first reactive component 204, a tuning adjuster circuit 206, and a post-matching component (circuit) 208. The post-matching component (circuit) 208 is connected to a transceiver module (not shown) through a signal 210. Furthermore, the apparatus 200 shows the tuning adjuster circuit 206 to include an RF switch 212 and a plurality of reactive components 214.

As an example of present implementations herein, the radiator 108 includes two adjacent monopole radiators 108-2 and 108-4, which may be symmetric with one another and are fed approximately along a centerline or middle portion of the portable device 102. The mechanical integration of the monopole radiators 108-2 and 108-4 may include extending its respective open ends to corners of the portable device 102.

Although the length of the monopole radiators 108-2 and 108-4 may define its initial resonant frequency (e.g., at middle frequency band of about 1710-2170 MHz), the initial resonant frequency may be adjusted later after its mechanical integration into the portable device 102. In other words, the length of the monopole radiators 108-2 and 108-4 may be designed based on the available space in the portable device 102.

After installation of the monopole radiators 108-2 and 108-4 into the portable device 102, the pre-matching component (circuit) 202, first reactive component 204, tuning adjuster circuit 206, and/or the post-matching component (circuit) 208 may facilitate generation of the initial resonant frequency. These components are referred to as active impedance components for adjusting the impedance matching (i.e., electrical tuning) of the combined monopole radiators 108-2 and 108-4.

With continuing reference to FIG. 2, the radiation at lower resonant frequencies such as 704-960 MHz in the portable device 102 is limited by configuration of the chassis 104, by a printed circuit board (PCB) where the tuning and/or matching circuitry 106 is located, and by other metallic mechanical parts of the portable device 102. Radiation efficiency of a radiator or antenna at these lower frequencies is depending on the chassis 104 dimensions. However, at higher frequencies such as at 1710-2170 MHz and at 2500-2690 MHz, the (metallic) chassis 104 may be configured to be larger in terms of wavelength so that the monopole radiators 108-2 and 108-4 are main contributors of radiation during its operation.

In an exemplary implementation, the pre-matching component (circuit) 202 is a circuit that is configured to perform impedance matching of the combined monopole radiators 108-2 and 108-4. The pre-matching component (circuit) 202 is preferably disposed along centerline of the radiator 108, because there are two current maxima along feed-points. There are two feed points 216-2 and 216-4, one for each monopole radiator 108-2 and 108-4 respectively, of the radiator 108, this configuration reduces a specific absorption ratio (SAR) value along edges of the portable device 102.

The pre-matching component (circuit) 202 is further configured to generate impedance at point 218, such that the impedance at the point 218 includes dual resonant characteristics in the combined monopole radiators 108-2 and 108-4. The dual resonant characteristic is depending on a direction of the radiator or antenna.

As an example of present implementations herein, the first reactive component 204 is configured to provide an initial tuning of the radiator 108. That is, regardless of initial length and size of the radiator 108, the first reactive component 204 may facilitate a particular resonant frequency such as a first frequency range for the radiator 108. For example, the impedance of the radiator 108 may be adjusted by the inductance or value of the first reactive component 204. The adjustment may include the radiator 108 to resonate at the first frequency range.

In an exemplary implementation, the tuning adjuster circuit 206 is configured to further change the impedance at the RF switch 212 through reactive components 214. For example, the RF switch 212 is single-pole-multiple-throw (SPMT) (this particular example shows a single-pole-4-throw or SP4T) switch that connects the point 218 to each of the plurality of reactive components 214. In this example, each of the plurality of reactive components 214 has different amount of inductances that may be connected in parallel with the first reactive component 204. This connection may then alter the impedance as seen at the point 218. It is contemplated that other arrangements of the reactive components 214 may be implemented, such as combining in series the reactive components 214, in order to achieve different amounts of inductance. Furthermore, tuning adjuster circuit 206 may be implemented using different configurations to achieve different amounts of inductance.

Depending upon the value of the resulting inductance as seen at the point 218, different resonance frequency points may be configured for the combined monopole radiators 108-2 and 108-4. In other implementations, capacitors are further connected in series and/or parallel with the plurality of reactive components 214.

In an exemplary implementation, the post-matching component 208 may involve a simple capacitor in series with the point 218 in order to match a standard 50 Ohm transmission line impedance in between the radiator 108 and the transceiver module. In this exemplary implementation, the post-matching component 208 and the pre-matching component 202 form the impedance to further compensate for electrical effects of the components in between the radiator 108 and the transceiver module. For example, the integration of the tuning adjuster component 206 and the first reactive component 204 may generate a mismatch in the apparatus 200. The mismatch may result to a power reflection that minimizes efficiency of radiation in the apparatus 200. The pre-matching component 202 and post-matching component 208 may be used to compensate for the power reflection.

Figure 3:
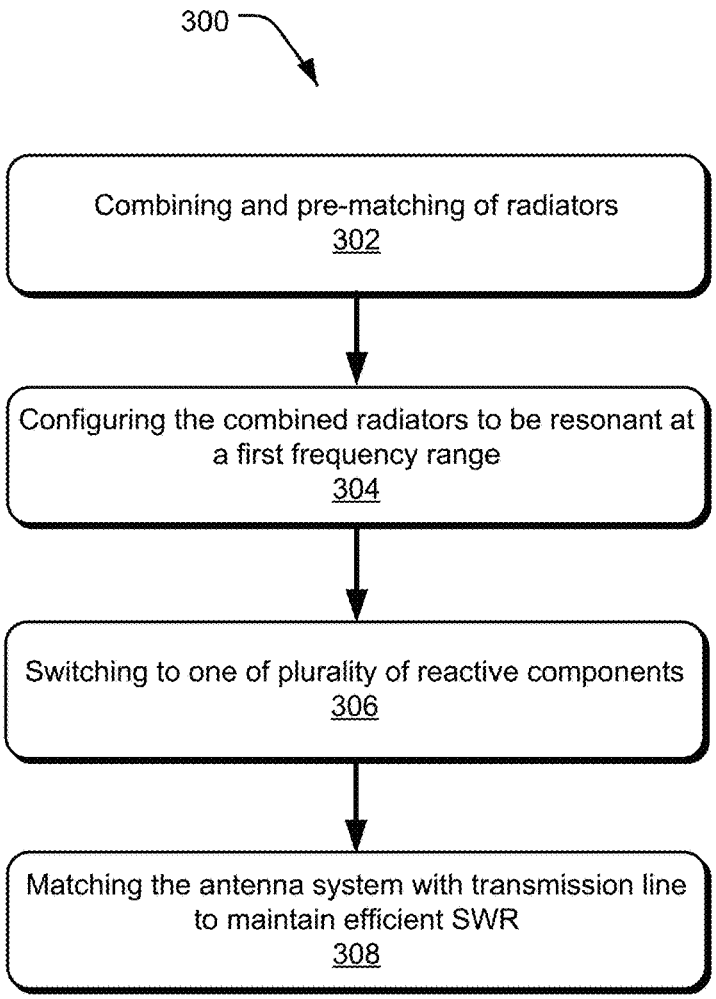
FIG. 3 is an example process chart illustrating an example method for electrical tuning of miniaturized radiators in a portable device.

FIG. 3 shows an example process chart 300 illustrating an example method for electrical tuning of miniaturized radiators in a portable device. For example, the electrical tuning involves use of active impedance components. The order in which the method is described is not intended to be construed as a limitation, and any number of the described method blocks can be combined in any order to implement the method, or alternate method. Additionally, individual blocks may be deleted from the method without departing from the spirit and scope of the subject matter described herein. Furthermore, the method may be implemented in any suitable hardware, software, firmware, or a combination thereof, without departing from the scope of the invention.

At block 302, combining and pre-matching of radiators is performed. For example, two monopole radiators 108-2 and 108-4 are combined to form a single radiator 108. Pre-matching component 202 may perform an initial pre-matching of the monopole radiators 108-2 and 108-4. In this example, the monopole radiators 108-2 and 108-4 may be initially designed based on a space available in a portable device 102 during mechanical integration. In other words, the monopole radiators 108-2 and 108-4 may not initially be of a particular length so as to be resonant at a certain frequency. Moreover, the combination is performed such that a feeding point is somewhere along centerline of the combined monopole radiators.

As an example of present implementations herein, the pre-matching is further performed so that the combined monopole radiators 108-2 and 108-4 will have a lesser amount of power reflection. The pre-matching is performed along the feeding point, which is in the centerline of the combined monopole radiators. Pre-matching component 202 along with post-matching component 204 may perform the pre-matching of the monopole radiators 108-2 and 108-4.

At block 304, configuring the combined radiator to resonate at a first frequency range is performed. The pre-matching component (circuit) 202, first reactive component 204, tuning adjuster circuit 206, and/or the post-matching component (circuit) 208 may facilitate generation of the initial resonant frequency. For example, the combined monopole radiators 108-2 and 108-4 may have a resonance frequency at a first frequency range. The resonance frequency may be facilitated by a first reactive component such as the first reactive component 204. The first reactive component 204 may include a simple inductor, or it may include a simple inductor in series and/or in parallel with a capacitor.

As discussed above, the initial physical length of the radiator 108 may be based upon the space available during the mechanical integration to the portable device 102. After the mechanical integration or installation of the radiator 108, the impedance may be adjusted through the first reactive component 204 in order to resonate at the first frequency range. The first frequency range, for example, may start at a middle frequency range (e.g., 1710-2170 MHz) and then subsequently adjusted to resonate at other frequency ranges by changing the inductance at point 216.

At block 306, switching to one of plurality of reactive components is performed. The described RF switch 212 may perform this function. For example, the tuning adjust component 206 has different reactive components 214 to shunt the first reactive component 204. In this example, shunting of the first reactive component 204 with another reactive component 214 may result in a different reactance at the point 216. As a result, another resonance frequency range is generated at the radiator 108.

As an example of present implementations herein, a single-pole multiple-throw RF switch 212 may facilitate the connection of the shunting reactive component 214 to the first reactive component 204. However, during the first resonant frequency, the RF switch is not connected at all to the plurality of reactive components. In other words, the RF switch is left open so that the monopole radiators 108 will resonate at the first frequency range as configured through the use of the first reactive component 204.

In an exemplary implementation, the different reactive components 214 when combined with the first reactive component 204 may cover operating frequencies for Global System for Mobile communications (GSM) 850, 900, 1800, and 1900 bands; wideband code division multiple access (WCDMA) 1, 2, 4, 5, and 8 bands; and long term evolution (LTE) 1, 2, 3, 4, 5, 7, 8, 17, and 20 bands.

At block 308, post-matching is performed by a post matching component. For example, a post-matching circuit is added to the pre-matching circuit to form the impedance matching circuitry of the apparatus 200. The impedance matching circuitry may be utilized to counter the electrical effects of additional components in between the combined monopole radiators 108-2 and 108-4 and the transceiver module (i.e., transmitter and/or receiver circuitry). This includes, for example, the plurality of reactive components 214 and the first reactive component 204 that were described above.

The following examples pertain to further embodiments:

Example 1 is an apparatus comprising: a radiator; a first reactive component coupled to the radiator, the first reactive component is configured to adjust impedance of the radiator to resonate at a first frequency range; and a tuning adjuster circuit that is connected to the first reactive component, the tuning adjuster comprising a plurality of reactive components.

In Example 2, the apparatus as recited in Example 1, wherein, the first reactive component is selectively coupled to the plurality of reactive components to generate a plurality of resonant frequencies.

In Example 3, the apparatus as recited in any of Examples 1 or 2, wherein the radiator includes a plurality of monopole radiators with a feed-point disposed along a centerline of the plurality of monopole radiators.

In Example 4, the apparatus as recited in any of Examples 1 or 2, wherein the radiator has a length based on an available space in a portable device, wherein the first reactive component is configured to adjust impedance of the radiator by changing reactance of the first reactive component, plurality of reactive components, or a combination of the first reactive component and the plurality of reactive components.

In Example 5, the apparatus as recited in Example 2 further comprising a pre-matching component that is connected between the first reactive component and the radiator, wherein the pre-matching component is configured to match impedance at a feed-point of the plurality of monopole radiators.

In Example 6, the apparatus as recited in any of Examples 1 or 2 further comprising a combiner circuitry configured to combine the plurality of monopoles radiators into a single radiator, wherein each end of the plurality of monopole radiators extend to edges of a portable device.

In Example 7, the apparatus as recited in any of Examples 1 or 2, wherein the tuning adjuster circuit further comprises a radio frequency (RF) switch that connects the plurality of reactive components to the first reactive component.

In Example 8, the apparatus of Example 7, wherein the RF switch is a single-pole-multiple throw switch.

In Example 9, the apparatus as recited in any of Examples 1 or 2, wherein the tuning adjuster circuit includes a radio frequency (RF) switch that is an open circuit at the first frequency range.

In Example 10, the apparatus of Example 9, wherein the RF switch is a single-pole-multiple throw switch.

In Example 11, the apparatus as recited in any of Examples 1 or 2 further comprising a post-matching component and a pre-matching component, wherein the post-matching component and the pre-matching component are configured to match impedance of the first reactive component and the tuning adjuster circuit, which are disposed in between a transceiver module and the radiator.

Example 12 is a portable device comprising: a plurality of combined monopole radiators; a first reactive component coupled to the plurality of combined monopole radiators, the first reactive component is configured to set the plurality of combined monopole radiators to resonate at a first frequency range; and a tuning adjuster circuit connected to the first reactive component, the tuning adjuster circuit comprising a plurality of reactive components selectively coupled with the first reactive component to generate a plurality of resonant frequencies.

In Example 13, the portable device as recited in Example 12, wherein the plurality combined monopole radiators is comprised of two monopole radiators and a feed-point disposed along a centerline of the two monopole radiators.

In Example 14, the portable device as recited in Example 13, wherein ends of the two monopole radiators extend to edges of the portable device.

In Example 15, the portable device as recited in any of Examples 12 or 14, wherein the tuning adjuster circuit further comprises a radio frequency (RF) switch that connects each of the plurality of reactive components to the first reactive component.

In Example 16, the portable device as recited in any of Examples 12 or 14, wherein the tuning adjuster circuit includes a radio frequency (RF) switch that is an open circuit at the first frequency range.

In Example 17, the portable device as recited in any of Examples 12 or 14 further comprising a pre-matching component connected between the first reactive component and the combined monopole radiators, wherein the pre-matching component has a matching impedance at a feed-point of the combined monopole radiators.

In Example 18, the portable device as recited in any of Examples 12 or 14 further comprising a post-matching component and a pre-matching component, wherein the post-matching component and the pre-matching component form impedance matching to circuit components disposed between a transceiver module and the combined monopole radiators.

Example 19 is a method of electrically tuning radiators in a portable device, the method comprising: combining and pre-matching a plurality of radiators to form a combined radiator; configuring the combined radiator to resonate at a first frequency range; selective switching at least one of a plurality of reactive components to generate a resonant frequency; and post-matching the combined radiators with the resonant frequency.

In Example 20, the method as recited in Example 19, wherein the combining and pre-matching of a plurality of radiators includes positioning a feed-point along a centerline of the combined radiators.

In Example 21, the method as recited in Example 19, wherein the configuring to resonate at the first frequency range includes connecting the combined radiator to a first reactive component.

In Example 22, the method as recited in Example 19, wherein the combining and pre-matching of the plurality of radiators includes positioning each ends of the combined radiator to extend along edges of a portable device.

In Example 23, the method as recited in any of Examples 19, 20, 21 or 22, wherein the switching utilizes a radio frequency (RF) switch that connects each of the plurality of reactive components to a first reactive component.

What is claimed is:

1. An apparatus comprising:

a radiator including a first radiator and a second radiator;

a first reactive circuit having a first end coupled to the radiator, the first reactive circuit having a predetermined impedance and being configured to adjust an impedance of the radiator to cause the radiator to resonate at a first frequency range;

a tuning adjuster circuit that is connected to the first end of the first reactive circuit, the tuning adjuster having an adjustable impedance and comprising a plurality of second reactive circuits, each second reactive circuit from among the plurality of second reactive circuits having a different selectable predetermined impedance to cause the radiator to resonate at a frequency that is different than the first frequency range based upon which of the plurality of second reactive circuits is selected; and a pre-matching component configured to match a combined impedance of the first radiator and the second radiator to the first reactive circuit, wherein the first reactive circuit is coupled to the pre-matching component via a point on a transmission line that has an impedance matching that of the pre-matching component.

2. The apparatus of claim 1, wherein the tuning adjuster circuit is configured to generate the resonance at the different frequencies by impedance matching with the radiator.

3. The apparatus of claim 1, wherein the different selectable impedance of each second reactive circuit of the plurality of second reactive circuits is a different inductance as compared to another second reactive circuit of the plurality of second reactive circuits.

4. The apparatus of claim 3, wherein each second reactive circuit from among the plurality of second reactive circuits are combinable to cause the radiator to resonate at different frequencies.

5. The apparatus of claim 4, wherein each second reactive circuit from among the plurality of second reactive circuits are combinable in parallel.

6. The apparatus of claim 4, wherein each second reactive circuit from among the plurality of second reactive circuits are combinable in series.

7. The apparatus of claim 1, wherein at least one of a second reactive circuit of the plurality of second reactive circuits is coupled in parallel with the first reactive circuit.

8. The apparatus of claim 1, wherein the first end of the first reactive circuit is coupled to the radiator through a pre-matching component.

9. The apparatus of claim 8, further comprising:

a post-matching component coupled to the tuning adjuster circuit and to the radiator, the post-matching component being in series with the pre-matching component and a transceiver, wherein the post-matching component is configured to compensate for impedance mismatches caused by the tuning adjuster circuit and the first reactive circuit.

10. The apparatus of claim 1, wherein the radiator has a feed point that is located substantially at a center of the radiator.

11. The apparatus of claim 1, wherein each of the first radiator and the second radiator is a monopole radiator.

12. The apparatus of claim 1, further comprising:

a post-matching component connected to the tuning adjuster circuit and the radiator, the post-matching component being configured to compensate for impedance mismatches caused by the tuning adjuster circuit and the first reactive circuit.

13. The apparatus of claim 12, wherein the post-matching component is configured to match a transmission line characteristic impedance to the radiator.

14. The apparatus of claim 12, wherein the post-matching component comprises a capacitor.

15. The apparatus of claim 1, wherein the first radiator and the second radiator have a feed point that is located substantially at a center of each respective radiator.

16. The apparatus of claim 1, wherein the ground plane includes a metallic chassis.

17. The apparatus of claim 16, wherein the metallic chassis is a first arm of a dipole antenna, and wherein the radiator including the first radiator and the second radiator is a second arm the dipole antenna.

18. The apparatus of claim 17, wherein the first radiator and the second radiator have a feed point that is located substantially at a center of each respective radiator to reduce a specific absorption ratio (SAR) value along edges of the apparatus as compared to the first radiator and the second radiator having a feed point located at an end of each respective radiator.

19. The apparatus of claim 1, further comprising:

a ground plane over which the first radiator and the second radiator are disposed, the first and the second radiator forming a first portion of an antenna, and the ground plane forming a second portion of the antenna.

20. The apparatus of claim 19, wherein the first portion of the antenna formed by the first and the second radiator is configured to radiate as one half of the antenna, and wherein the second portion of the formed by the ground plane is configured to radiate as a second half of the antenna.

* * * * *